United States Patent [19]

Eikelenboon

[11] Patent Number: 4,861,185

[45] Date of Patent: Aug. 29, 1989

[54] COLLAPSIBLE ROAD BARRIER

[76] Inventor: Peter A. J. Eikelenboon, Nijverheidscentrum 6, 2706 AA Zevenhuizen, Netherlands

[21] Appl. No.: 209,371

[22] Filed: Jun. 21, 1988

[51] Int. Cl.[4] ..... E01F 9/00

[52] U.S. Cl. ..... 404/6; 49/33; 49/131

[58] Field of Search ..... 404/9, 10, 11, 6; 49/33, 34, 49, 9, 131; 188/371, 376, 377

[56] References Cited

U.S. PATENT DOCUMENTS

| | | | |
|---|---|---|---|
| 3,674,115 | 6/1972 | Young | 404/6 |
| 4,572,080 | 2/1986 | Williams | 404/6 |
| 4,647,246 | 3/1987 | Brink | 404/6 |

FOREIGN PATENT DOCUMENTS

| | | |
|---|---|---|
| 0092282 | 4/1983 | European Pat. Off. . |
| 3112717 | 10/1982 | Fed. Rep. of Germany . |
| 2165569 | 5/1986 | United Kingdom . |

*Primary Examiner*—Jerome W. Massie, IV
*Assistant Examiner*—Gay Ann Spahn
*Attorney, Agent, or Firm*—Watson, Cole, Grindle & Watson

[57] ABSTRACT

A collapsible road barrier comprises a foundation pit, a frame located in the foundation pit, an expandable barrier element mounted in the frame, at least one energy absorption element extending from a rear wall of the foundation pit to a rear side of the frame, and at least one stretching element connected between the front side of the frame and the front wall of the foundation pit, such that vehicle impact against the barrier element will cause the frame to first move towards the rear wall of the foundation pit, causing the energy absorption element(s) to compress and the stretching element(s) to extend and eventually break, and then pivot upwardly to stop the vehicle.

5 Claims, 8 Drawing Sheets

COLLAPSIBLE ROAD BARRIER

The invention relates to a retractable road barrier comprising an expandable barrier element and at least one energy absorption element. Such a road barrier is known from GB-A-No. 2 165 569.

The object of the invention is to improve this known road barrier in such a way that with a light construction of the barrier element, which has a small mass and consequently can be erected quickly from the retracted position to the blocking position—something which is very important in use—the energy of a vehicle driving onto the expanded road barrier is absorbed in controlled fashion in the optimum manner.

The accumulated energy in a vehicle driving onto the road barrier is first partially absorbed by deformation of the front side of the vehicle and of the barrier element; before the vehicle has come to a standstill, the whole frame will, in a subsequent phase, shift in the direction of travel, while energy is absorbed by the energy absorption element (for example one or more energy absorption pipes which are known per se), by the displacement of the frame and by the stretching element. The latter will break when a specific tensile loading is reached, the consequence being that the barrier element on the drive-on side is no longer fixed in the vertical direction and will start to tilt about an axis near the drive-off side of the barrier, as a result of which the initial horizontal movement of the vehicle is converted into a movement with a considerable vertical component. The remaining vehicle energy is thereby absorbed and the vehicle falls back on the road barrier. Of course, the number and shape of the energy absorption elements and stretching elements can be chosen as desired, so that the road barrier can be adapted optimally to the requirements set for it—for a road barrier which is intended only to impede the passage of motor cars will have different dimensions from those of the road barrier which also has to be capable of stopping armored vehicles.

It is pointed out that DE-A-No. 3 112 717 described a road barrier with chains provided on the front side, the sole object of which is to limit the maximum angle of expansion of the barrier element: the insight to provide on the front side of the road barrier a downward-running stretching element which not only absorbs energy, but also breaks when a particular load is reached and permits tilting of the whole independent frame is not found in this publication.

BRIEF DESCRIPTION OF THE DRAWINGS

The invention is explained with reference to the drawings, in which.

DETAILED DESCRIPTION OF THE PREFERRED EMBODIMENT

Figure 1:
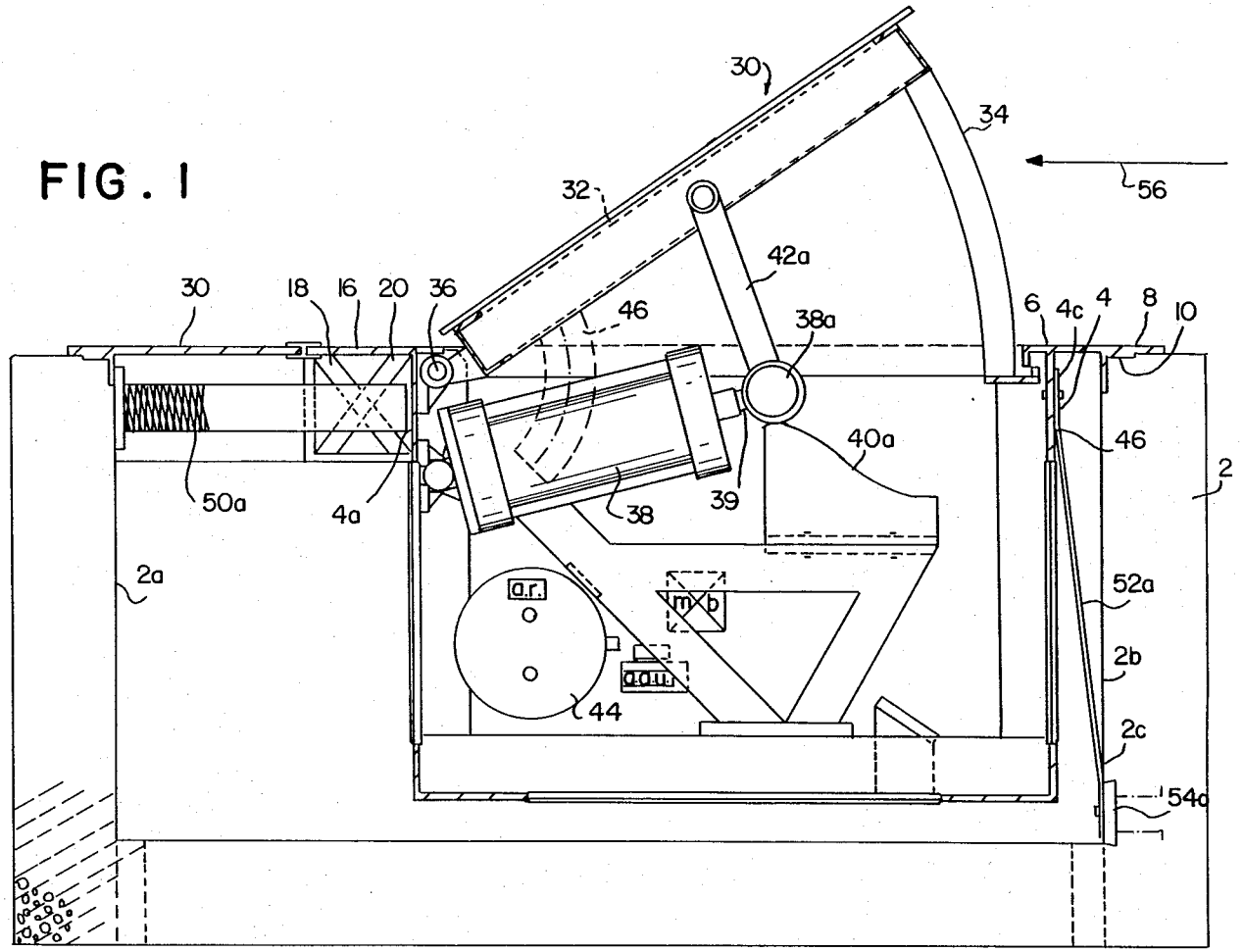
FIG. 1 is a longitudinal section through the road barrier according to the invention.
Figure 2:
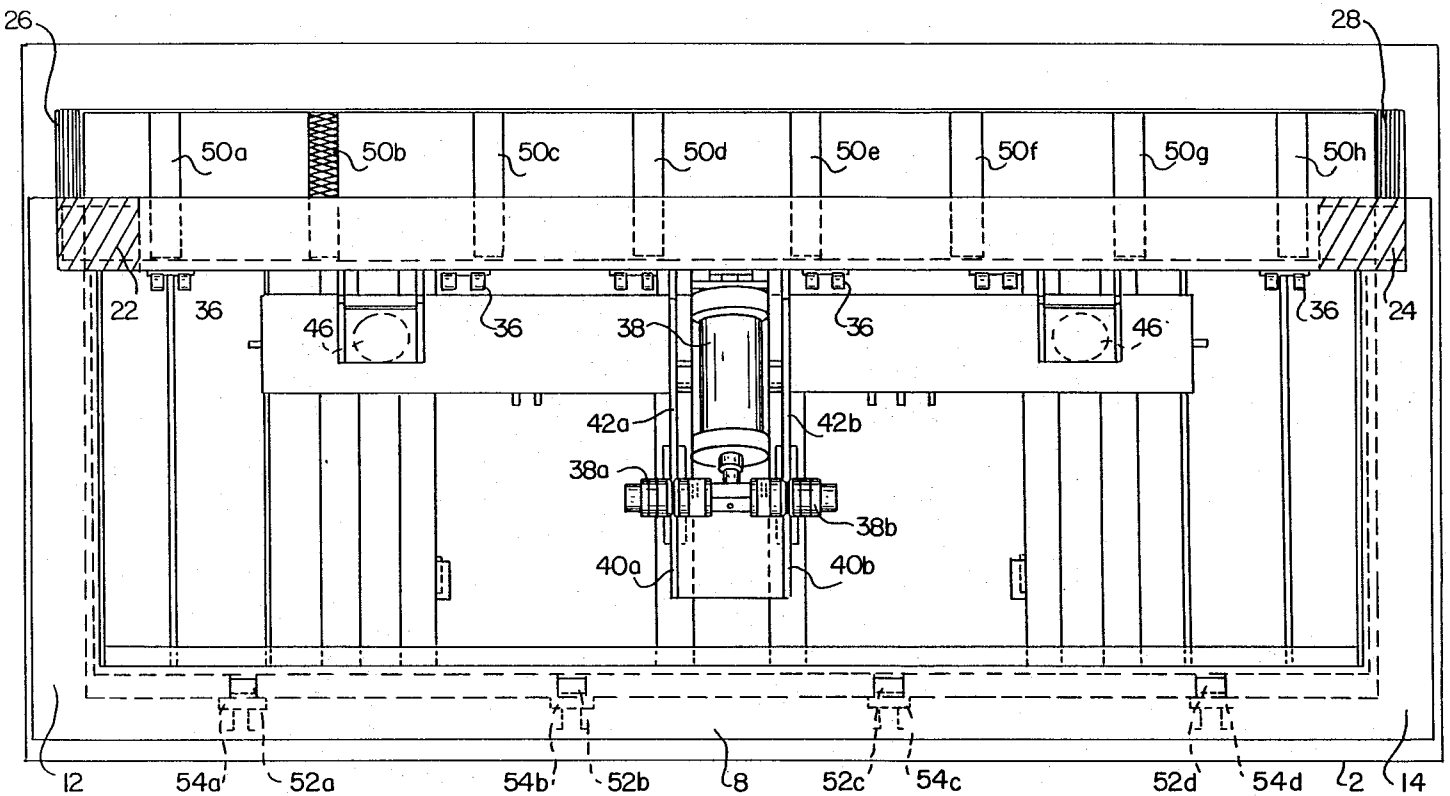
FIG. 2 is a top view of various parts thereof.

The illustrated road barrier according to the invention comprises a foundation pit 2 accommodating an independent frame 4, which on the top side 6 rests with the plate 8 on the front edge 10 of the foundation pit 2, and with the two longitudinal edges 12 and 14 also rests with cover plates (not shown) on the edges of the foundation pit. The frame 4 carries on its rear end a corner bar 16. The latter has on both ends short counter-corner sections 22 and 24, which are each reinforced with section parts 18, 20 which are welded crosswise therein, and which—as shown in FIG. 2—project on either side over a short distance beyond the frame and are guided in guide tracks 26, 28 recessed in the foundation pit 2 and thus form the sliding pivot points. A foundation pit cover plate 30 competes the whole unit.

The frame 4 has the usual elements, known per se from, for example EP-A-No. 0 092 282, in the name of applicant, such as the expandable barrier element 30, made up of the usual barrier element cover plate 32, which covers the road barrier in the normal passing position and has on the front side thereof the closure element 34; by means of the hinges 36, this barrier element is carried by the frame 4. The expansion takes place through the action of the pneumatic cylinder 38 in combination with the run-on rollers **38*a*, 38*b* fixed on the piston rod 39 thereof, the run-on plates 40*a*, 40*b* and the hinge arm 42*a*, 42*b*; the compressed air is supplied by a compressor (not shown) via a buffer tank 44, so that even when the compressor cuts out the barrier can still be operated a number of times, while there are also the schematically shown compression springs 46**, which are known per se.

According to the invention, the rear side **4*a* of the frame 4, in fact the corner bar 16, is by means of a number of energy absorption elements 50*a*–50*h*, here designed as the "crumple pipes" which are known per se (only one of which is shown schematically), supported against the rear wall 2*a* of the foundation pit 2, while the front side 4*b* is connected to the front wall 2b of the foundation pit by means of a number—in this case 4—of stretching strips 52*a*–52*d* breaking at a specific load. They run from the top edge 4*c* of the frame to the bottom edge 2*c* of the foundation pit in which they are fixed with anchors 54*a*–54*d*, so that when the stretching strips are intact the top side of the frame is fixed in the vertical direction. It will be clear from the above that the invention deliberately creates the possibility that, when a great force is exerted on the road barrier in the direction of the arrow 56, the whole frame can move backwards in the direction of arrow 56 against the action of the crumple pipes 50*a*–50*h* and with stretching of the stretching strips 52*a*–52*d*. When the latter finally break, the front side of the frame is no longer fixed in the vertical direction, and the whole frame can tilt upwards around the corner sections 22, 24, constituting guide elements projecting in the guide tracks, 26, 28 respectively. The fact that this results into optimum energy absorption and blocking action is explained below with reference to FIGS. 3 to 8**.

In these figures are, for the sake of clarity, only the elements of the road barrier which are necessary for a good understanding of the functioning, shown.

Figure 3:
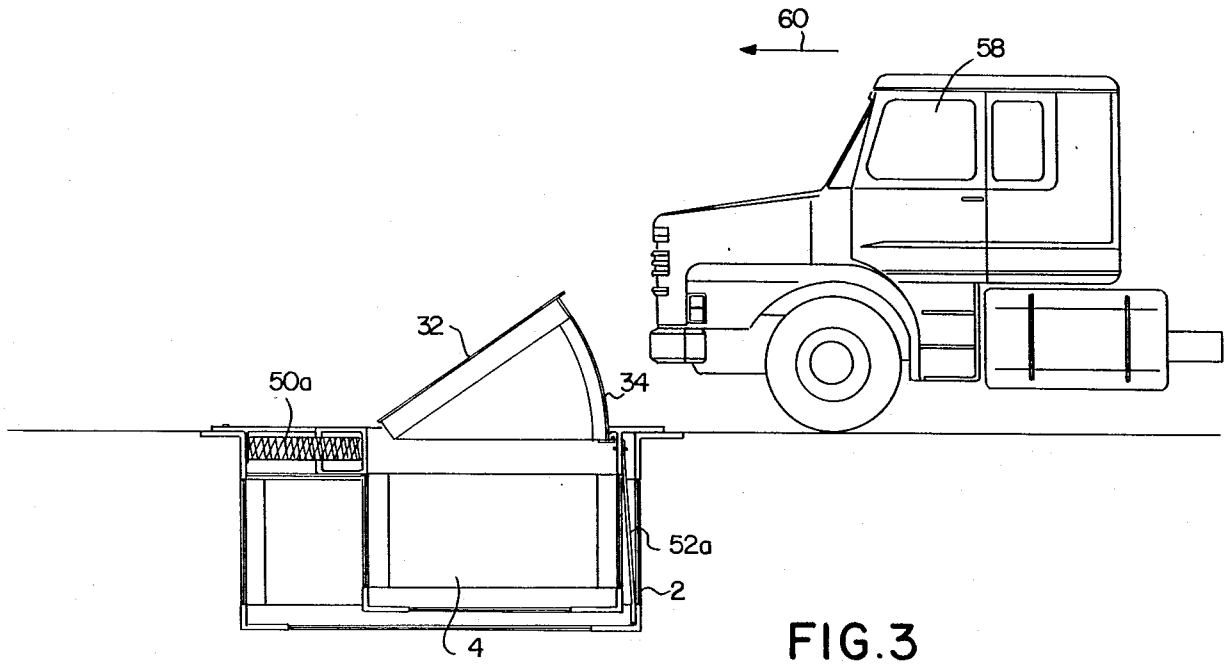
FIGS. 3 to 8 show the various phases of the deformation occurring when a vehicle drives onto the barrier, in which kinetic energy of the colliding vehicle is absorbed in a controlled way.

FIG. 3 shows the situation in which a heavy motor vehicle 58 is driving onto the expanded road barrier in the direction of the arrow 60. This vehicle has a certain kinetic energy which according to the invention is deliberately absorbed in a number of phases.

Figure 4:
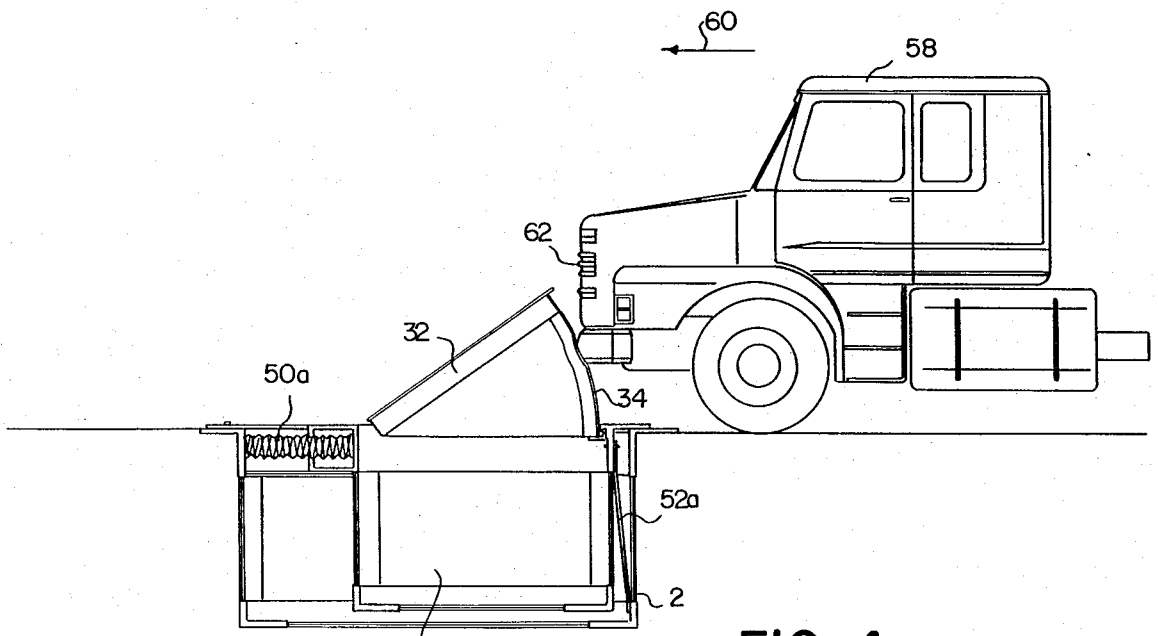

The first phase, shown in FIG. 4, is the contact between the front side 62 of the vehicle 58 and the closing element 34, resulting in a slight deformation of the two elements.

Figure 5:
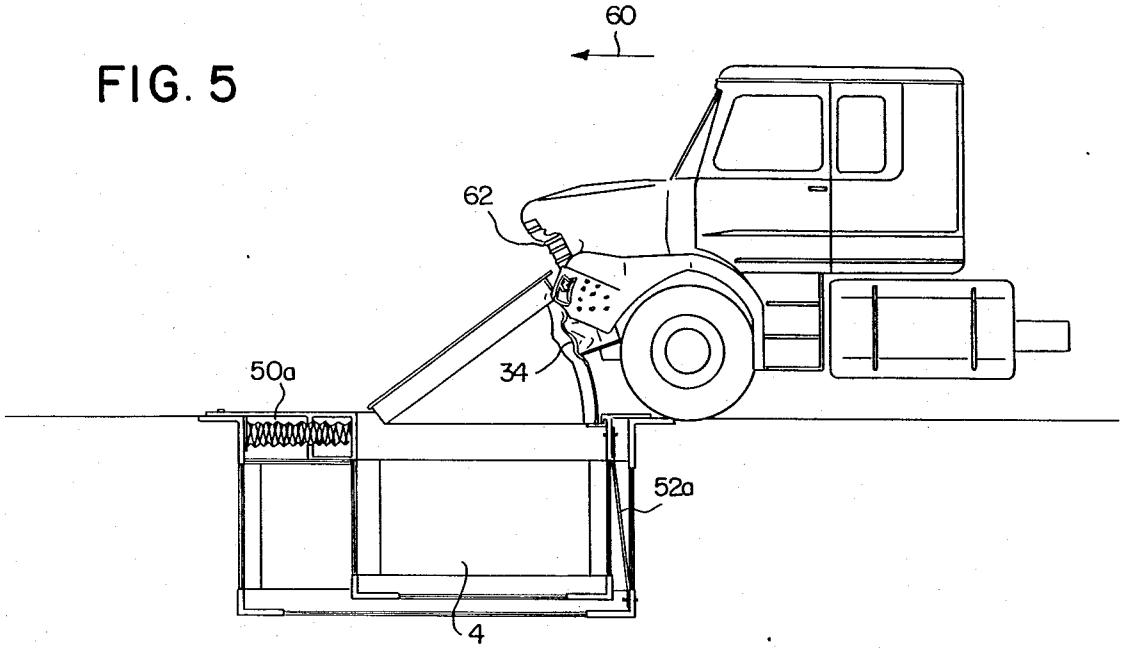
Figure 6:
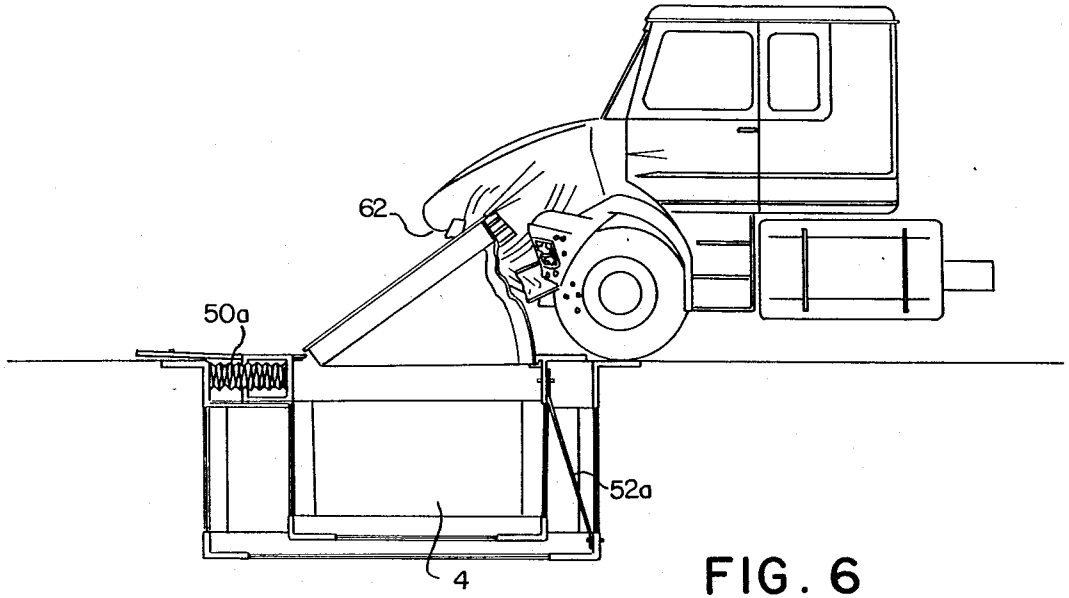
Figure 7:
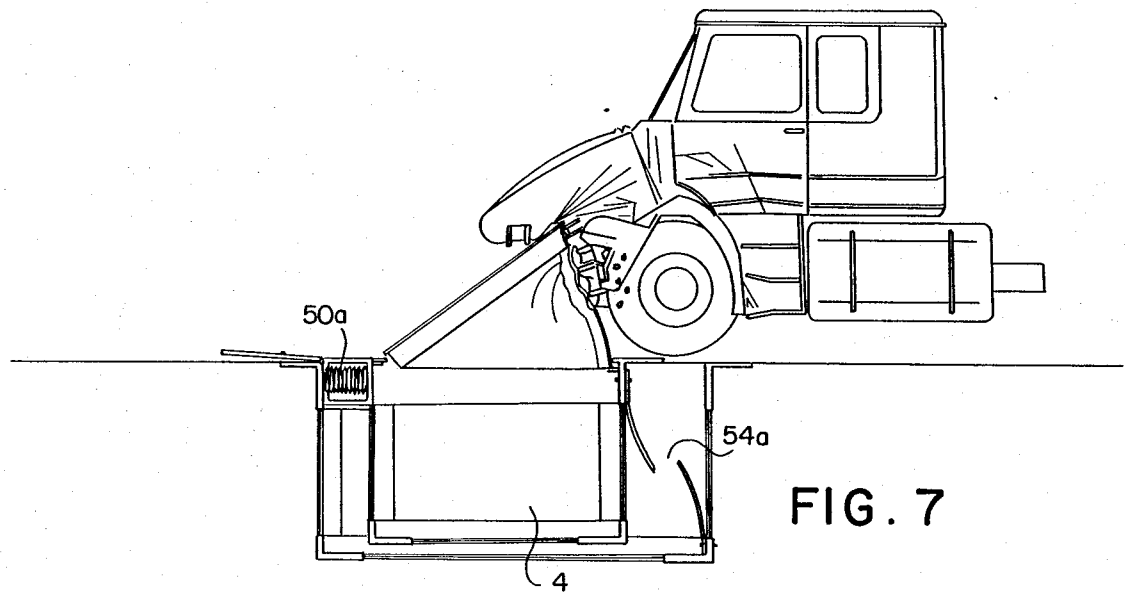
Figure 8:
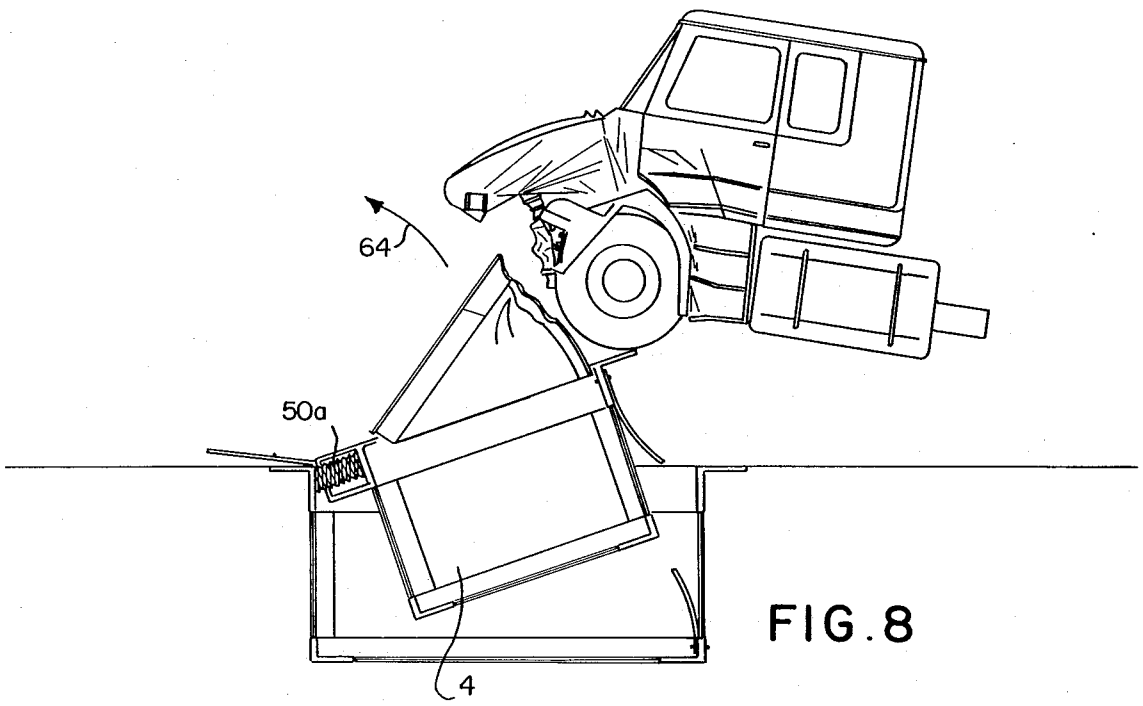

The second phase, shown in FIG. 5, is that in which both the front side 62 of the vehicle and the closing element 34 are deformed to a great extent. This already permits a small displacement of the frame in the direction of the arrow 60, with a slight deformation of the crumple pipes 50*a*–50*b* and a slight elongation of the stretching strips 52*a*–52*d*. FIG. 6 shows the next phase, in which the stretching strips 52*a*–52*d* are stretched even further and the crumple pipes 50*a*–50*h* are pressed down over an appreciable distance. In the following phase, shown in FIG. 7, the stretching strips 52*a*–52*d* finally break, and the crumple pipes 50*a*–50*h* are completely crushed; the breaking of the stretching strips results in that the front side of the road block is no longer fixed in the vertical direction. As a result of the difference in height between the guide elements 22, 24 in the guide tracks 26, 28 respectively, on the one hand, and the action point, on the other and the kinetic energy of the vehicle is at that moment not entirely absorbed, the frame 4 will tilt upwardly. This situation is shown in FIG. 8, wherein the upward movement is indicated by the arrow 64; the movement takes place around the guide parts 22 and 24 (see FIG. 2), thereby causing the front of the vehicle to be lifted up and the residual energy acting in the horizontal direction to be absorbed by the lifting of the front of the vehicle. The latter will eventually rise up virtually vertically with its front, and will finally fall back without the road barrier having been passed.

It is clear that after such an event the road barrier can be restored quickly to its original state at relatively low cost: only the closing element 34, the crumple pipes 50*a*–50*h* and the stretching strips 52*a*–52*d* need replacing.

I claim:

1. A collapsible road barrier which comprises a foundation pit having a front wall, a rear wall and a floor, a frame which is positioned in said foundation pit, said frame having a front side and a rear side, an extendable barrier element mounted within said frame, an energy absorption element extending between said rear wall of said foundation pit and said rear side of said frame, and a stretching element which is connected from said front side of said frame near a top edge thereof to said front wall of said foundation pit near said floor, said collapsible road barrier functioning such that a vehicle moving towards said rear wall of said foundation pit from said front wall and impacting said extendable barrier element will cause said frame to move towards said rear wall of said foundation pit, thereby causing said energy absorption element to become compressed and said stretching element to become stretched and to break, said frame then pivoting upwardly in order to stop the movement of the vehicle.

2. A collapsible road barrier according to claim 1 wherein said foundation pit includes opposite side walls defining guide tracks, and wherein said frame includes guide elements adjacent said rear side thereof that respectively project into said guide tracks.

3. A collapsible road barrier according to claim 2, wherein said frame includes a corner bar connected to a top end of said rear side, and wherein said guide elements are located at opposite ends of said corner bar.

4. A collapsible road barrier according to claim 1, including a plurality of energy absorption elements extending in spaced apart fashion between said rear wall of said foundation pit and said rear side of said frame.

5. A collapsible road barrier according to claim 1, including a plurality of stretching elements connected in spaced apart fashion between said front side of said frame and said front wall of said foundation pit.

* * * * *